United States Patent [19]

Benton et al.

[11] Patent Number: 4,828,756

[45] Date of Patent: May 9, 1989

[54] ELECTRICALLY CONDUCTIVE COMPOSITES OF POLYACETYLENE AND HIGH-NITRILE RESINS AND METHOD THEREOF

[75] Inventors: Kenneth C. Benton, Macedonia; Raymond J. Weinert, Jr., Garfield Heights; Lawrence E. Ball, Akron, all of Ohio

[73] Assignee: The Standard Oil Company, Cleveland, Ohio

[21] Appl. No.: 143,541

[22] Filed: Jan. 13, 1988

Related U.S. Application Data

[63] Continuation of Ser. No. 933,491, Nov. 21, 1986, abandoned, which is a continuation of Ser. No. 743,327, Jun. 15, 1985, abandoned.

[51] Int. Cl.[4] ..... H01B 1/20

[52] U.S. Cl. ..... 252/518; 252/500; 252/511; 428/515; 428/520; 428/522; 525/199; 525/202; 525/217; 525/238

[58] Field of Search ..... 252/500, 511, 518; 525/199, 202, 217, 238; 420/515, 520, 522

[56] References Cited

U.S. PATENT DOCUMENTS

| | | | |
|---|---|---|---|
| 4,222,903 | 9/1980 | Heeger et al. | 252/500 |
| 4,374,948 | 2/1983 | Adams et al. | 525/310 |
| 4,454,178 | 6/1984 | Naarman et al. | 428/290 |
| 4,456,548 | 6/1984 | Lewis et al. | 252/518 |
| 4,519,939 | 5/1985 | Hocker et al. | 252/518 |

*Primary Examiner*—Robert Wax

*Attorney, Agent, or Firm*—Larry W. Evans; Joseph G. Curatolo; Teresan W. Gilbert

[57] ABSTRACT

An electrically conductive composite comprising conductive polyacetylene moiety, a nonconductive high nitrile resin, and a dopant. The high nitrile resin further comprises at least nitrile monomers or comonomers and optionally copolymerized with comonomers of monoethylenically unsaturated monomers and conjugated diolefins and further optionally containing an elastomeric component.

The invention further includes a process for producing an electrically conductive composite comprising:

(1) impregnating a high nitrile resin with a Zeigler type catalyst comprising an alkyl aluminum compound and alkyl, alkyl halide, halide, oxyhalide or alkoxide of Group IVA and VA metals, (2) exposing the impregnated high nitrile resin with an alkyne under polymerization conditions whereby polymerization occurs to form a polyacetylene/nitrile composite, and (3) adding dopant to the composite.

45 Claims, No Drawings

ELECTRICALLY CONDUCTIVE COMPOSITES OF POLYACETYLENE AND HIGH-NITRILE RESINS AND METHOD THEREOF

This is a continuation of co-pending application Ser. No. 933,491, filed Nov. 21, 1986, now abandoned, which is a continuation of co-pending application Ser. No. 743,327, filed June 15, 1985, now abandoned.

BACKGROUND OF THE INVENTION

The present invention is directed generally to electrically conductive composites containing polyacetylene and high nitrile polymers. The invention relates to the preparation of electrically conductive composites such as polyacetylene in a high nitrile polymer matrix that can optionally contain mono-ethylenically-unsaturated comonomers, conjugated diolefins or mixtures thereof. In another aspect, the invention relates to novel electrically conductive composites, which composites are environmentally stable, exhibit solvent resistance and have good uniformity of dispersion.

Conductive polymer are highly sought after at the present time to serve as substitutes for metals in a variety of applications conducting electricity. Many varieties of electronically conductive polymers are known in the art. These compositions have varied in their polymer structure and have included conductive components of polyacetylene, polypyrrole, poly-p-phenylene and poly-p-phenylene sulfide. Polyacetylene is a material of considerable interest because it can be rendered highly conductive by treatment with a variety of electron donors or acceptors. However, these organic polymer compositions lose stability under ambient conditions, rapidly lose their conductivity when exposed to ambient atmosphere, have poor mechanical properties and poor processability. There exists a need for develop conducting polymers with improved properties.

A current approach as found in M. E. Galvin and G. E. Wnek, *J. Polymer Sci., Polymer Chemistry Ed.* 21, 2727 (1983), and U.S. Pat. No. 4,394,304 involves the in situ polymerization of acetylene in polymer films of low-density polyethylene, impregnated with a catalyst. These composites have good mechanical properties and conductivities. These composites, however, suffer from inadequate air stability in that the conductivity dramatically decreases over a short period of time upon exposure to air. Furthr, these composites suffer from poor uniformity.

It is an object of this invention to provide electrically conductive composites comprising polyacetylene and high nitrile resin. It is another object of this invention to provide electrically conductive composites that are environmentally stable when exposed to ambient atmosphere. It is another object of this invention to distribute the polyacetylene uniformly throughout the electrically conductive composites. It is another object of this invention to provide lightweight and inexpensive devices for electromagnetic interference shielding.

These and other objects, together with the advantages over known methods, shall become apparent from the specification which follows and are accomplished by the invention as hereinafter described and claimed.

SUMMARY OF THE INVENTION

It has now been found that electrically conductive composites of polyacetylene can be prepared in the presence of high nitrile resins as a means of protecting the conductive polymer from the deleterious effects of the ambient atmosphere. The use of high nitrile resins provide greater protection to the conductive polymer since nitrile resins are excellent barriers to deleterious components of the atmosphere. The present invention further provides that the high nitrile resins also function as a component of the polymerization catalyst system so that there is uniform distribution of the polyacetylene in the composite.

This invention relates to an electrically conductive composite comprising a conductive polyacetylene moiety, a nonconductive high nitrile resin, the high nitrile resin further comprising at least nitrile polymers or copolymers, and a dopant. Optionally the high nitrile resin comprises comonomers selected from the group consisting of unsaturated mono-ethylenically unsaturated monomers, conjugated diolefins and mixtures thereof and further optionally an elastomeric component.

The invention further includes a process for producing an electrically conductive composite comprising:

(1) impregnating a high nitrile resin with a Zeigler type catalyst comprising an alkyl aluminum compound and a material selected from the group consisting of alkyl, alkyl halide, alkoxide or oxyhalide of Group IVA and VA metals, (2) exposing the impregnated high nitrile resin to acetylene under polymerization conditions whereby polymerization occurs to form a polyacetylene/nitrile composite, and (3) adding dopant to the composite.

Conductive polymer are presently in demand to serve as substitutes for metals in a variety of applications conducting electricity. The electrically conductive composites of this invention can be used as shielding against electromagnetic interference. The electrically conductive composite of this invention can be used as a means for reducing or eliminating electromagnetic emissions as well as electromagnetic pickup by enclosing the device of concern in conductive materials of the present invention. Further, the composites of this invention are useful as electrostatic shielding of electric power cable and other articles. Furthermore, the composites of the instant invention are useful as tapes, shielding layers and other types of articles.

DETAILED DESCRIPTION OF THE INVENTION

The electrically conductive composites of the instant invention are the products of the polymerization of conductive organic polymer precursors in the presence of a high nitrile resin.

Conductive organic polymers that can be used in the practice of this invention may be any of those which can be prepared by polymerization in the presence of the matrix high nitrile polymer. Further, conductive organic polymer precursors that can be used in the practice of this invention include alkynes, non-conjugated diynes and the like. The conductive organic polymer precursors useful in this invention can be prepared by any method known in the art. Alkynes are characterized as acetylenic hydrocarbons which are a class of unsaturated hydrocarbons having the generic formula $C_nH_{2n-2}$ and a structural formula containing a carbon to carbon triple bond. Un-conjugated diynes are characterized as alpha, omega-alkyl diynes, composed of chains of methylene groups with acetylenic units at each end of the chain. These conductive organic polymer precursors can be employed alone or in combinations.

The electrically conductive composites generally contain the conductive organic polymer from about 2 percent to about 75 percent, preferably from about 3 percent to about 50 percent and most preferably from about 4 percent to about 25 percent of the total weight without dopant.

The alkynes and their derivatives and homologues useful in forming conductive organic polymers include but are not limited to acetylene, methylacetylene, trifluoromethylacetylene, cyclohexyl acetylene, cyanoacetylene and the like. Most preferred is acetylene.

The un-conjugated diynes and their derivatives and homologues useful in forming conductive organic polymers include but are not limited to 1,6-heptadiyne, 1,5-hexadiyne and the like. Most preferred is 1,6-heptadiyne.

The second component of the electrically conductive composites of the present invention are high nitrile resins. The high nitrile resin matrix suitable for use in the instant invention are nitrile polymers and copolymers. The high nitrile resins useful in this invention can be prepared by any method known in the art. Representative examples of nitrile resins and their preparation include those disclosed in U.S. Pat. Nos. 4,379,875 and 4,374,948. The nitrile monomers can be employed alone or in combinations.

The electrically conductive composites generally contain high nitrile resin from about 25 percent to about 98 percent, preferably from about 50 percent to about 95 percent, and most preferably from about 75 percent to about 94 percent of the total weight without dopant. When monomers or copolymers of nitrile monomers are employed in the matrix with comonomers of monoethylenically unsaturated monomers, conjugated diolefins or mixtures thereof, then the composites contain from about 50 to about 5 weight percent, preferably from about 30 to about 15 weight percent comonomers of the total weight without dopant.

The nitrile monomers and their derivatives and homologues useful as monomers, homopolymers or copolymers in forming the high nitrile resins include but are not limited to acrylonitrile, methacrylonitrile, 1,1-dicyanoethylene, tetracyanoethylene, itaconic acid nitrile, crotonic acid nitrile, alpha methylene glutaronitrile and the like. The most preferred are acrylonitrile and methacrylonitrile.

The monomers suitable for use as comonomers with the high nitrile resins are selected from the group consisting of monoethylenically unsaturated comonomers, conjugated diolefin comonomers and mixtures thereof. The unsaturated monoethylene comonomers and conjugated diolefin comonomers can be prepared by any method known in the art. The unsaturated monoethylene and conjugated diolefin comonomers can be employed alone or in combination.

The monoethylenically-unsaturated comonomer component copolymerizable with the high nitrile resins includes acrylates, vinyl aromatics, mono-alpha-olefins, cyclic olefins, vinylesters of carboxylic acids, vinyl halides, vinylidene halides and the like.

The acrylates and their derivatives and homologues include but are not limited to methyl acrylate, methyl methacrylate, ethyl acrylate, n-butyl acrylate, lauryl methacrylate, cyclohexyl acrylate and the like. The most preferred are methyl acrylate, methyl methacrylate and ethyl acrylate.

The vinyl aromatics and their derivatives and homologues include but are not limited to styrene, alpha-methylstyrene, para-t-butyl styrene, para-methyl styrene and the like. The most preferred are styrene and alpha-methylstyrene.

The mono-alpha-olefins and their derivatives and homologues include but are not limited to ethylene, propylene, 1-butene, 1-hexene, i-butylene and the like. The most preferred are ethylene, propylene and i-butylene.

The cyclic olefins and their derivatives and homologues include but are not limited to norbornene, indene, 5-methylene 2-norbornene, 5-ethylidene-2-norbornene, dicyclopentadiene and the like. The most preferred are norbornene, indene, and 5-ethylidene-2-norbornene.

The vinylesters of carboxylic acids and their derivatives and homologues include but are not limited to vinyl acetate, vinyl stearate and the like. The most preferred is vinyl acetate.

The vinyl halides and their derivatives and homologues include but are not limited to vinyl chloride, vinyl fluoride, vinyl bromide and the like. The most preferred is vinyl chloride.

The vinylidene halides and their derivatives and homologues include but are not limited to vinylidene chloride, vinylidene fluoride and the like. The most preferred is vinylidene chloride.

Other exemplary monoethylenically-unsaturated comonomers include but are not limited to maleic anhydride, diethyl maleate, dibutyl maleate and diethyl fumarate.

The conjugated diolefin comonomer component copolymerizable with the high nitrile resins include but are not limited to 1,3-butadiene; 2-methyl 1,3-butadiene; 2,3-dimethyl-1,3-butadiene; 2-chloro 1,3-butadiene; 1,3-pentadiene, 3 methyl 1,3-pentadiene; 4 methyl 1,3-pentadiene; 1,3-hexadiene and the like. The most preferred are 1,3-butadiene; 2-methyl 1,3-butadiene; and 2,3-dimethyl 1,3-butadiene.

Various elastomeric materials are likewise suitable for admixture in the present invention as an additive to the resin. Typical elastomeric materials suitable for the present invention include but are not limited to conjugated diolefin copolymers, conjugated diolefin homopolymers, ethylene-propylene-diene terpolymers, and the like.

The conjugated diolefin copolymers and their derivatives and homologues include but are not limited to butadiene-acrylonitrile copolymer, styrene-butadiene copolymer, styrene-isoprene copolymer and the like. The most preferred are butadiene-acrylonitrile copolymer and styrene-butadiene copolymer.

The conjugated diolefin homopolymers and their derivatives and homologues include but are not limited to polybutadiene, polyisoprene, poly(2-chloro-1,3-butadiene), poly(2,3-dimethyl-1,3-butadiene) and the like. The most preferred are polybutadiene and polyisoprene.

The ethylene-propylene-diene terpolymers and their derivatives and homologues include but are not limited to ethylene-propylene-(5-ethylidene-2-norbornene), ethylene-propylene-1, 4-hexadiene and the like.

It will be readily apparent to those skilled in the art that composites of the instant invention may be further modified by the addition of plasticizers, stabilizers, pigments, dispersants, extenders, fillers, reinforcing agents and other film formers. The composites of the instant invention may also optionally contain various UV light absorbers, antioxidant agents and dyes. All these additives and the use thereof are well known in the art and do not require extensive discussion, it being understood that any compound possessing the ability to function in such as manner, i.e., as a plasticizer, antioxidants agent, UV light absorber and the like, can be used so long as they do not deleteriously affect the electrically conductive composite and do not adversely affect the characteristics of the composite.

The electrically conductive composites of the present invention are prepared by in situ polymerization. The high nitrile resin matrix is immersed in a hydrocarbon solution of the catalyst components to form a Zeigler type catalyst complex. The catalyst component comprises an alkyl aluminum compound and alkyl, alkylhalide, alkoxide, or oxyhalide of Group IVA and VA metals of the Periodic Table of Elements as found in the 61st edition of the Handbook of Chemistry and Physics. The ratio of Zeigler type catalyst complex used to the high nitrile resin is as high as about 1.5 to about 1 and as low as about 0.06 to about 1. Further, the ratio of the alkyl aluminum compound to the alkyl, alkylhalide, alkoxide, or oxyhalide of Group IVA and VA metals is about 1 to about 5 to about 5 to about 1. It is preferable to mix the high nitrile resin with an alkyl aluminum compound to form a co-catalyst complex which is then exposed to alkyl, alkylhalide, alkoxides of Group IVA and VA or oxyhalide.

Alkyl aluminum compounds include but are not limited to triethylaluminum, trimethylaluminum, triisobutylaluminum, tri-n-hexylaluminum, diethylaluminum chloride, ethyl aluminum sesquichloride, diisobutylaluminum hydride, 1-phenyl-2-(diethylalumino)-1-heptene and the like. The most preferred is triethylaluminum.

Alkyl, alkylhalide, alkoxide, or oxyhalide of Group IVA and VA metals include but are not limited to tetra(isobutyl)titanate, tetra(n-butyl)titanate, tetra(isopropyl)titanate, dicyclopentadienyltitanium dichloride, dicyclopentadienylzirconimum dimethyl, vanadium triacetylacetonate, vanadium oxytrichloride and the like. The most preferred is tetra(isobutyl)titanate.

The high nitrile resin matrix is immersed in a hydrocarbon solution of catalyst components under an inert substantially oxygen free atmosphere and can optionally be heated from about 30° C. to about 90° C. The high nitrile resin Zeigler type catalyst complex may be heated for about 0.5 hours to about 18 hours. The high nitrile resin Zeigler type catalyst complex is then exposed to the organic polymer precursor allowing the polymerization reaction to occur forming the composite. The polymerization occurs at a temperature from about −78° C. to about +95° C., preferably from about −40° C. to about +25° C. Further the polymerization occurs at a pressure from about 1 psig to about 25 psig, preferably about 5 psig to about 15 psig. Polymerization can be carried out for about one minute to about three hours, preferably for about five minutes to about one hour.

The composite is then doped to introduce electron donors or electron acceptors to the composite to obtain the desired electrical properties. Doping is performed by exposing the composite to the doping agent, vapor or immersing the composite in a solution of the doping agent at ambient temperature of about 15° C. to about 30° C. The doping time is dependent upon the physical characteristics of the composite and the chemical properties of the dopant. However, doping exposure time is generally from about 18 hours to about 1000 hours. Doping agents and the procedure thereof are generally well known in the art. Examples of suitable n-type doping agents include but are not limited to iodine, sulfuric acid, perchloric acid, arsenic pentafluoride, antimony pentafluoride, molybdenum pentachloride, tungsten hexachloride and the like. Examples of suitable p-type dopants include but are not limited to potassium naphthalide, sodium naphthalide, lithium naphthalide and the like. Most preferred is iodine.

Alternatively, laminates of the organic polymer with high nitrile resins can be prepared by pressing an organic polymer film between high nitrile resin films. These procedures are generally well known in the art. The organic polymer and the high nitrile resin of the instant invention are made separately into films by known methods in the art. The organic polymer film is doped by exposing the organic polymer film to the doping agent as above. The organic polymer film is then laminated between the high nitrile resin films. The organic polymer film and high nitrile resin films are pressed together by means of pressure and temperature. The temperatures is from about 180° C. to about 260° C. preferably from about 200° C. to about 230° C. The laminating pressure can vary from about 2000 psig to about 20,000 psig, preferably from about 5,000 psig to about 10,000 psig.

The electrically conductive composites of the present invention are comprised of the reactive products of the high nitrile resins and the conductive organic polymers. It is theorized that in situ polymerization of the organic polymer and the high nitrile resin provides an effective means of incorporating or intertwining the conductive organic polymer with the high nitrile resin matrix, because the alkylaluminum reacts with the high nitrile resin to form an effective co-catalyst for Zeigler type catalyst in polymerization. Thus, the use of such co-catalyst with Zeigler type catalyst in the polymerization of organic molecules would effectively incorporate the organic molecules with the high nitrile resin matrix resulting in good uniformity. It is theorized that during the lamination process there is crosslinking and cyclization occurring between the high nitrile resins and the organic polymers of the different films.

The use of a high nitrile resin improves the durability and environmental stability of the composites of the present invention due to the barrier properties of the high nitrile resins. The combination of conductive organic polymers and high nitrile resins into a composite results in good uniformity, conductivity and environmental stability.

SPECIFIC EMBODIMENTS

The following examples demonstrate the process and advantages of the present invention.

Test Method

The following electrically conductive composites 1, 2, and 3 were prepared by dissolving about 3.1 g of polyacrylonitrile powder in about 31.3 g of N,N dimethylformamide containing about 0.65 g of ethylenecarbonate to control the evaporation rate of the solvent at ambient temperatures. A film was cast of approximately 5.4×2.3×0.0037 cm (centimeters) on a glass microscope slide by adding the solution onto the slide and then allowing the solvent to evaporate by placing the slide on a warm hot plate. The film was further dried at about 50° C. in a vacuum oven at less than about 50 mm of mercury for about 60 hours. The film was then transferred to a glove box with a dry argon atmosphere. Approximately 0.2 ml to about 0.5 ml of tetra(isobutyl)titanate was applied to the film, followed by about 0.2 ml to about 0.6 ml of triethyl aluminum (25 weight percent in toluene). The film was rinsed with n-heptane and then aged for about fifteen minutes and transferred to a jar with an inlet and outlet tube. Acetylene was admitted to the jar at about 4 psig, at about 20° C. and for about 30 minutes. The resulting composite was washed with toluene. Then the composite was immersed in n-pentane saturated with iodine for about 24 hours. Then the pentane was evaporated off the composite. The conductivity was measured by the four probe technique and the results are reported in Table 1.

Composite Compositions

| | Composition | Percent |
|---|---|---|
| Example 1 | Polyacrylonitrile | ~54 |
| | Acetylene | ~18 |
| | Iodine | ~28 |
| Example 2 | Polyacrylonitrile | 69 |
| | Acetylene | 14 |
| | Iodine | 17 |
| Example 3 | Polyacrylonitrile | 92 |
| | Acetylene | 3 |
| | Iodine | 5 |

In example 1 there was a failure of equipment; therefore the inventor has determined by his best effort the percent of the components in the composition by reviewing the method used to prepare the composition and the results obtained.

A four-probe array is used in determining the conductivity. A direct current is passed through the specimen between the outer probes and the resistance is measured between the inner probes by using a GenRad Model 1666 DC Resistance Bridge. The conductivity is calculated by a standard equation from the resistance measurement.

The results of the conductivity test show that the environmentally stable electrically conductive composites of the present invention demonstrate good electrical conductivity.

Although the invention has been described in detail through the preceeding examples, these examples are for the purpose of illustration only, and it is understood that variations and modifications can be made by one skilled in the art without departing from the spirit and the scope of the invention.

TABLE 1

Conductivities of Polymer Composites

| Composition | Thickness (cm) | Conductivity (s/cm) |
|---|---|---|
| 1 | 0.0037 | 1.75 |
| 2 | 0.0042 | $6.7 \times 10^{-4}$ |
| 3 | 0.0042 | $<5 \times 10^{-5}$ |

We claim:

1. An electrically conductive composite comprising:

a high nitrile polymer film matrix comprising from about 25% to about 96% by weight of said composite without a dopant;

a conductive alkyne polymer, polymerized in situ in the presence of said high nitrile polymer film matrix and incorporated therewith and comprising from about 4% to about 75% by weight of said composite without a dopant; and a dopant.

2. The electrically conductive composite of claim 1 wherein said high nitrile polymer film is formed with comonomers selected from the group consisting of monoethylenically unsaturated monomers, conjugated diolefins and mixtures thereof.

3. The electrically conductive composite of claim 1 wherein said high nitrile polymer film is formed with elastomeric components selected from the group consisting of conjugated diolefin copolymers, conjugated diolefin homopolymers, ethylene-propylenediene terpolymer and mixtures thereof.

4. The electrically conductive composite of claim 1 wherein conductive polyacetylene is selected from the group consisting of alkynes and unconjugated diynes.

5. The electrically conductive composite of claim 4 wherein the alkyne is selected from the group consisting of acetylene, methylacetylene, trifluoromethylacetylene and cyclohexylacetylene.

6. The electrically conductive composite of claim 5 wherein the alkyne is acetylene.

7. The electrically conductive composites of claim 4 wherein the unconjugated diynes are selected from the group consisting of 1,6-heptadiyne and 1,5-hexadiyne.

8. An electrically conductive composite of claim 7 wherein the unconjugated diyne is 1,6-heptadiyne.

9. The electrically conductive composite of claim 1 wherein said high nitrile polymer film comprise from about 50% to about 95% by weight of said composite without dopant.

10. The electrically conductive composite of claim 1 wherein said high nitrile polymer film comprises from about 75% to about 94% by weight of said composite without dopant.

11. The electrically conductive composite of claim 1 wherein said comonomer comprises from about 50% to about 5% by weight of said composite without dopant.

12. The electrically conductive composite of claim 1 wherein said comonomer comprises from about 30% to about 15% by weight of said composite without dopant.

13. An electrically conductive composite of claim 1 wherein said high nitrile polymer film contains a monomer selected from the group consisting of acrylonitrile, methacrylonitrile, 1,1-dicyanoethylene, tetracyanoethylene, itaconic acid nitrile, crotonic acid nitrile and alpha methylene glutaronitrile.

14. An electrically conductive composite of claim 1 wherein said nitrile monomer is selected from the group consisting of acrylonitrile and methacrylonitrile.

15. The electrically conductive composite of claim 2 wherein the comonomer of monoethylenically unsaturated monomers is selected from the group consisting of acrylates, vinyl aromatics, mono-alpha-olefins, cyclic olefins, vinylester of carboxylic acids, vinyl halides and vinylidene halides.

16. An electrically conductive composite of claim 15 wherein the acrylates are selected from a group consisting of methyl acrylate, methyl methacrylate, ethyl acrylate, n-butyl acrylate, lauryl methacrylate and cyclohexyl acrylate.

17. The electrically conductive composite of claim 16 wherein the acrylates are selected from the group consisting of methylacrylate, methyl methacrylate and ethylacrylate.

18. An electrically conductive composite of claim 15 wherein the vinylaromatics are selected from the group consisting of styrene, alpha-methylstyrene, para-t-butylstyrene and para-methylstyrene.

19. An electrically conductive composite of claim 18 wherein the vinylaromatics are selected from the group consisting of styrene and alpha-methylstyrene.

20. An electrically conductive composite of claim 15 wherein the mono-alpha-olefins are selected from the group consisting of ethylene, propylene, 1-butene, 1-hexene and i-butylene.

21. An electrically conductive composite of claim 20 wherein the mono-alpha-olefins are selected from the group consisting of ethylene, propylene and i-butylene.

22. An electrically conductive composite of claim 15 wherein the cyclic olefins are selected from the group consisting of norbornene, indene, 5-methylene-2-norbornene, 5-ethylidene-2-norbornene and dicylcopentadiene.

23. An electrically conductive composite of claim 22 wherein the cyclic olefins are selected from the group consisting of norbornene, indene and 5-ethylidene-2-norbornene.

24. An electrically conductive composite of claim 15 wherein the vinyl esters of carboxylic acids are selected from the group consisting of vinyl acetate and vinyl stearate.

25. An electrically conductive composite of claim 24 wherein the vinyl ester of carboxylic acids is vinyl acetate.

26. An electrically conductive composite of claim 15 wherein the vinyl halides are selected from the group consisting of vinyl chloride, vinyl fluoride and vinyl bromide.

27. An electrically conductive composite of claim 26 wherein the vinyl halide is vinyl chloride.

28. An electrically conductive composite of claim 14 wherein the vinylidene halides are selected from the group consisting of vinylidene chloride and vinylidene fluoride.

29. An electrically conductive composite of claim 28 wherein the vinylidene halide is vinylidene chloride.

30. An electrically conductive composite of claim 2 wherein the comonomers of monoethylenically unsaturated monomer are selected from the group consisting of maleic anhydride, diethyl maleate, dibutyl maleate and diethyl fumarate.

31. An electrically conductive composite of claim 2 wherein the comonomer of conjugated diolefin are selected from the group consisting of 1,3-butadiene; 2-methyl 1,3-butadiene; 2,3-dimethyl-1,3-butadiene; 2-chloro-1,3-butadiene; 1,3-pentadiene, 3-methyl-1,3-pentadiene; 4-methyl-1,3-pentadiene; and 1,3-hexadiene.

32. An electrically conductive composite of claim 2 wherein the comonomer of conjugated diolefins is selected from the group consisting of 1,3-butadiene; 2-methyl 1,3-butadiene; 2,3-dimethyl 1,3-butadiene.

33. An electrically conductive composite of claim 1 wherein the dopant is selected from the group consisting of iodine, sulfuric acid, perchloric acid, arsenic pentafluoride, antimony pentafluoride, potassium naphthalide, sodium naphthalide, lithium naphthalide, molybdenum pentachloride and tungsten hexachloride.

34. An electrically conductive composite of claim 33 wherein the dopant is iodine.

35. A process for producing an electrically conductive composite comprising the steps of:

(1) impregnating a polymer film selected from the group consisting of nitrile polymers and high nitrile copolymers with a Ziegler-type catalyst comprising an alkyl aluminum compound and an alkyl, alkyl halide, alkoxide, or oxyhalide of a Group IVA metal, a Group VA metal or combinations thereof, wherein said polymer film comprises from about 75% to about 96% by weight of said composite without a dopant, (2) exposing said catalyst impregnated polymer film to acetylenic monomers under polymerization conditions whereby polymerization occurs to form a composite, wherein the polyacetylene comprises from about 4% to about 25% by weight of said composite without a dopant, and (3) exposing said composite to a dopant.

36. A process for producing an electrically conductive composite of claim 35 wherein the alkyl aluminum compound is selected from a group consisting of triethylaluminum, trimethylaluminum, triisobutylalumnium, tri-n-hexylaluminum, diethylaluminum chloride, ethylaluminum sesquichloride, diisobutylaluminumhydride and 1-phenyl-2-(diethylalumino)-1-heptene.

37. A process for producing an electrically conductive composite of claim 36 wherein the alkyl aluminum compound is triethylaluminum.

38. A process for producing an electrically conductive composite of claim 35 wherein the alkyl, alkylhalide, alkoxide or oxyhalides of Group IVA or VA metals is selected from the group consisting of tetra(isobutyl)titanate, tetra(n-butyl)titanate, tetra(isopropyl)titanate, dicyclopentadienyltitanium dichloride, dicyclopentadienylzirconium dimethyl, vanadiumtriacetylacetonate and vanadium oxytrichloride.

39. A process for producing an electrically conductive composite of claim 35 wherein the alkyl, alkylhalide and alkoxide of Group IVA on VA metals is tetra(isobutyl)titanate.

40. The process for producing an electrically conductive composite of claim 35 wherein said catalyst impregnated polymer film is exposed to the acetylene monomers at a temperature of about −78° C. to about +95° C.

41. The process for producing an electrically conductive composite of claim 35 wherein said catalyst impregnated polymer film is exposed to the acetylene monomer at a temperature of about −40° C. to about +25° C.

42. The process for producing an electrically conductive composite of claim 35 wherein said catalyst impregnated polymer is exposed to the acetylene monomer at a pressure of from about 1 psig to about 25 psig.

43. The process for producing an electrically conductive composite of claim 35 wherein said catalyst impregnated polymer film is exposed to the acetylene monomer at a pressure of from about 5 psig to about 15 psig.

44. The process for producing an electrically conductive composite of claim 1 wherein the dopant is selected from the group consisting of iodine, sulfuric acid, perchloric acid, arsenic pentafluoride, antimony pentafluoride, potassium naphthalide, sodium naphthalide, lithium naphthalide, molybdenum pentachloride and tungsten hexachloride.

45. The process for producing an electrically conductive composite of claim 44 wherein the dopant is iodine.

* * * * *